US008644528B2

(12) United States Patent
Mehregany

(10) Patent No.: US 8,644,528 B2
(45) Date of Patent: Feb. 4, 2014

(54) MICROFABRICATED MICROPHONE

(75) Inventor: Mehran Mehregany, San Diego, CA (US)

(73) Assignee: Case Western Reserve University, Cleveland, OH (US)

( * ) Notice: Subject to any disclaimer, the term of this patent is extended or adjusted under 35 U.S.C. 154(b) by 946 days.

(21) Appl. No.: 12/527,147

(22) PCT Filed: Feb. 19, 2008

(86) PCT No.: PCT/US2008/054302
§ 371 (c)(1),
(2), (4) Date: May 4, 2010

(87) PCT Pub. No.: WO2008/103672
PCT Pub. Date: Aug. 28, 2008

(65) Prior Publication Data

US 2010/0254560 A1 Oct. 7, 2010

Related U.S. Application Data

(60) Provisional application No. 60/890,762, filed on Feb. 20, 2007.

(51) Int. Cl.
*H04R 25/00* (2006.01)

(52) U.S. Cl.
USPC ..... 381/174; 381/191

(58) Field of Classification Search
USPC ..... 381/174, 191
See application file for complete search history.

(56) References Cited

U.S. PATENT DOCUMENTS

| | | | | |
|---|---|---|---|---|
| 4,142,074 | A | 2/1979 | Corbett | |
| 7,146,016 | B2 | 12/2006 | Pedersen | |
| 7,160,752 | B2 | 1/2007 | Quellet et al. | |
| 7,888,840 | B2 * | 2/2011 | Shimaoka et al. | 310/309 |
| 2007/0154040 | A1 * | 7/2007 | Chen | 381/174 |

* cited by examiner

*Primary Examiner* — Davetta W Goins
*Assistant Examiner* — Amir Etesam
(74) *Attorney, Agent, or Firm* — Tarolli, Sundheim, Covell & Tummino LLP

(57) ABSTRACT

The present invention provides a microfabricated microphone that can mitigate negative effects caused by residual stress in its sensing diaphragm. In particular, a center-supported diaphragm is provided to allow residual stress to relax through the radial expansion or contraction of the diaphragm. The diaphragm is suspended by an anchor that is attached to a supporting beam. The supporting beam is situated in between one or more sections of a back-plate electrode. The supporting beam is mechanically and electrically separated from the back-plate electrode. Various mechanical dimensions of the aforementioned components are also disclosed to optimize performance of a microfabricated microphone in different operational conditions. Further, a method and system for fabricating a microfabricated microphone with a center-supported diaphragm is also disclosed.

22 Claims, 16 Drawing Sheets

MICROFABRICATED MICROPHONE

CROSS REFERENCE TO RELATED APPLICATIONS

This application corresponds to PCT/US08/054,302, filed Feb. 19, 2008, which claims the benefit of U.S. Provisional Application No. 60/890,762, filed Feb. 20, 2007, which is herein incorporated by reference it its entirety.

TECHNICAL FIELD

The present invention relates generally to microfabricated microphones and, in particular, to a microfabricated microphone that consists of a center-supported diaphragm that mitigates residual stress.

BACKGROUND

New and more powerful electronic devices and computers are continually developed (e.g., digital audio players, video players, cell phones, personal digital assistants). As more new features are added into electronic devices and computers, there continues to be pressure in integrating and reducing the size of components within electronic devices. Particularly, the acoustic input components of electronic devices and computers are also subject to this size-reducing pressure. A conventional Electret Condenser Microphone (ECM) is an electro-mechanical component that has been used as an acoustic input component in electronic devices for many years. Even though the sizes of conventional ECMs have been reduced substantially (e.g., 4×1.5 mm), it is approaching its fundamental physical size limit.

MEMS (Micro Electro Mechanical Systems) technology has enabled the manufacturing of microfabricated microphones by utilizing robust processes from the semiconductor industry. Microfabricated microphones offer many advantages over traditional ECMs such as: substantial reduction in size, wider operational temperature ranges, more tolerance to moisture, lower manufacturing cost, compatibility with auto pick-and-place tools and standard reflow processes in installation and etc.

A microfabricated microphone generally consists of a flexible diaphragm and an electrically charged back-plate with damping holes. The diaphragm and the back-plate form a capacitor. Sound pressure can then dynamically deform the diaphragm to change the capacitance of the capacitor, and thus sound is transformed into electrical signals. In a conventional microfabricated microphone, all or substantially all edges of the diaphragm are mechanically fixed to the substrate in one form or another. This structural design prevents the residual stresses in the diaphragm thin film from relaxing. Residual stress in the sensing diaphragm can dominate the diaphragm's mechanical performance and, for example, reduce sensitivity with increasing residual tensile stress or lead to undesirable buckling of the diaphragm with increasing compressive stress. Thus, residual stress in the diaphragm can negatively affect a microfabricated microphone's sensibility, noise, and over-pressure response.

There are several conventional remedies to mitigate the effect of the residual stress on the mechanical behavior of the sensing diaphragm. One remedy is controlling residual stress to very low magnitudes. However, controlling residual stress requires very tight process control for consistent stress. Further, the mechanical behavior of the sensing diaphragms is usually dominated by the residual stress even within practical levels of residual stress. A more effective remedy is minimizing the effect of stress on diaphragm mechanics through mechanical designs. One method of minimizing the effect of residual stress through mechanical design is the 'free plate' scheme. (See Loeppert et al., U.S. Pat. No. 5,490,220). In the free plate scheme, the sensing diaphragm is largely free at the edges, with the exception of connection at a portion of the edge to a narrow arm, which is necessary for electrical connection to the diaphragm. Since the sensing diaphragm is mostly not attached to the substrate at its peripheral diameter, it allows the residual stress to relax through radial contraction or expansion of the diaphragm. However, the arm connected at a portion of the edge introduces radial and angular asymmetry in the sensing diaphragm structure, and as a result asymmetry in the stress relaxation. It is also necessary to mechanically confine the diaphragm to overcome the large compliance of the free plate attached at the end of the cantilever arm. Therefore, even though free plate scheme may mitigate some residual stress in the sensing diaphragm, there are still performance limits and complications in its manufacturing process.

SUMMARY

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The present invention relates to a microfabricated microphone that mitigates residual stress in its sensing diaphragm. In particular, a center-supported sensing diaphragm is provided to reduce negative effects associated with residual stress in the sensing diaphragms while maintaining radial and angular symmetry of the diaphragm structure. The diaphragm can be made from a thinner, bottom layer poly-silicon. The diaphragm can be attached to a supporting beam made from a thick top-layer poly-silicon, which is also used to form the back-plate. The back-plate electrode with perforations can be made from the same thick, top-layer poly-silicon. Various design features such as physical dimension modifications, material selections, material properties and etc. are also provided to optimize performance of microfabricated microphones in various operational environments.

Further, in accordance with one or more aspects of the present invention, a methodology for forming a microfabricated microphone is disclosed.

To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

DETAILED DESCRIPTION

The various aspects of the subject innovation are now described with reference to the annexed block diagrams and drawings, wherein like numerals refer to like or corresponding elements throughout. It should be understood, however, that the block diagrams, drawings and detailed description relating thereto are not intended to limit the claimed subject matter to the particular form disclosed. Rather, the intention is to cover all modifications, equivalents, and alternatives falling within the spirit and scope of the claimed subject matter.

The present invention provides a microfabricated microphone. The microphone consists of a center-supported diaphragm to mitigate negative effects of residual stress. In particular, the diaphragm can be anchored at its center allowing the residual stress to relax through radial contraction or expansion of the diaphragm. The diaphragm can consist of a single circular plate made from a thinner, bottom layer poly-silicon. The diaphragm can be attached mechanically and electrically to a supporting beam made from a thick top-layer poly-silicon. The back-plate can be made from the same thick, top-layer poly-silicon.

Figure 1A:
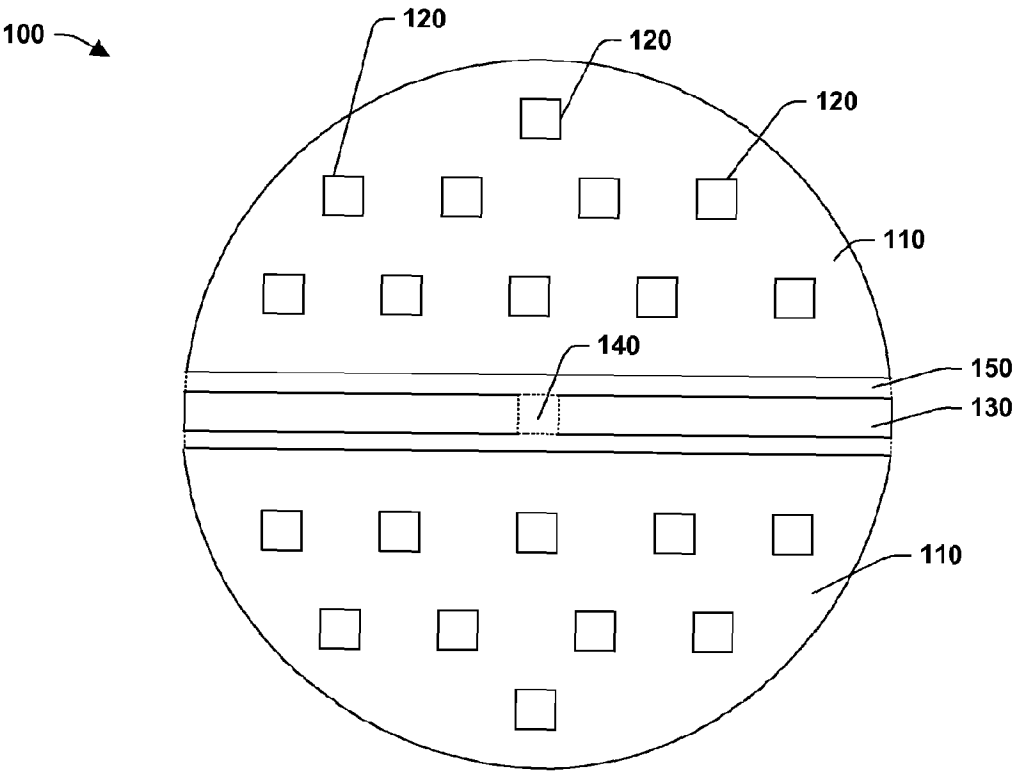
FIG. 1*a* is a diagram illustrating a top view of a back-plate diaphragm assembly in accordance with an aspect of the present invention.
Figure 1B:
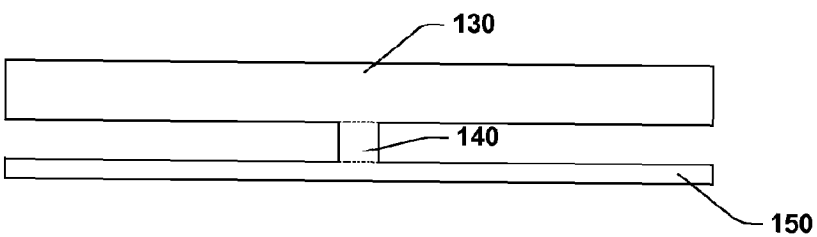
FIG. 1*b* is a diagram illustrating a side view of a back-plate diaphragm assembly in accordance with an aspect of the present invention.

Referring initially to FIG. 1*a* and FIG. 1*b*, the top and side view of a back-plate and diaphragm assembly 100 of a microfabricated microphone is illustrated in accordance with an aspect of the present invention. The back-plate and diaphragm assembly 100 can consist of a back-plate electrode 110, a plurality of back-plate perforations 120, a supporting beam 130, an attachment/anchor 140 and a diaphragm disk 150. The back-plate electrode 110 can be made from a thick, top-layer poly-silicon. The back-plate electrode 110 can consist of two half-circles and the two half-circles can be electrically connected. The diaphragm disk 150 can be a circular plate made from a thinner, bottom-layer poly-silicon. The diaphragm disk 150 can be attached mechanically and electrically to the supporting beam 130 through the attachment/anchor 140. Thus, the supporting beam 130, the attachment/anchor 140 and the diaphragm disk 150 can be mechanically and electrically connected.

The supporting beam 130 can be made from the same top-layer back-plate poly-silicon layer. The supporting beam 130 can be a doubly-clamped beam. The back-plate electrode can be divided into two sections. The doubly-clamped beam 130 can be situated in between the two sections of the back-plate electrode 110. The two sections of the back-plate electrode 110 can be electrically connected. However, the supporting beam 130 is mechanically and electrically separated from the two sections of the back-plate electrode 110. Therefore, the back-plate electrode 110 and the diaphragm disk 150 can form a parallel-plate capacitor to facilitate transforming mechanical energy into electrical signals—in accord with the basic operating principles of a microphone.

Additionally, the back-plate electrode 110, the supporting beam 130, the attachment anchor 140, and the diaphragm disk 150 can be made from other materials, including but not limited to polycrystalline Silicon Carbide (poly-SiC). Moreover, the poly-SiC can be an n-type Low Pressure Chemical Vapor Deposition (LPCVD) poly-SiC.

Figure 1C:
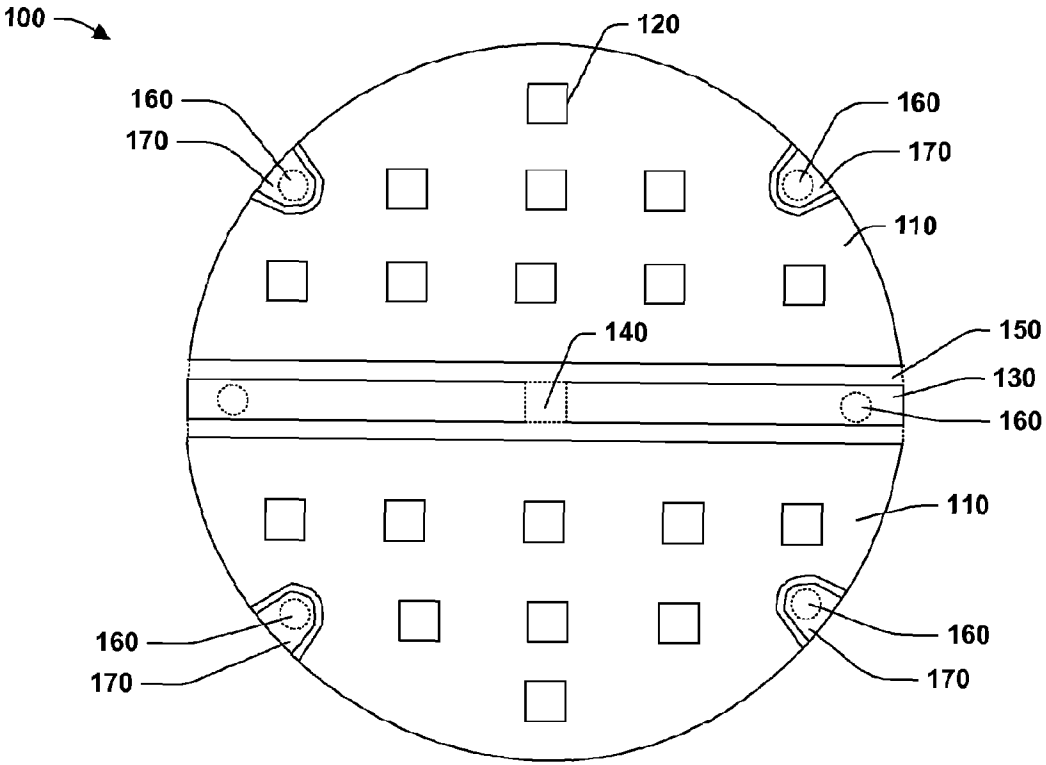
FIG. 1*c* is a diagram illustrating a top view of a back-plate diaphragm assembly with anti-stiction features in accordance with an aspect of the present invention.
Figure 1D:
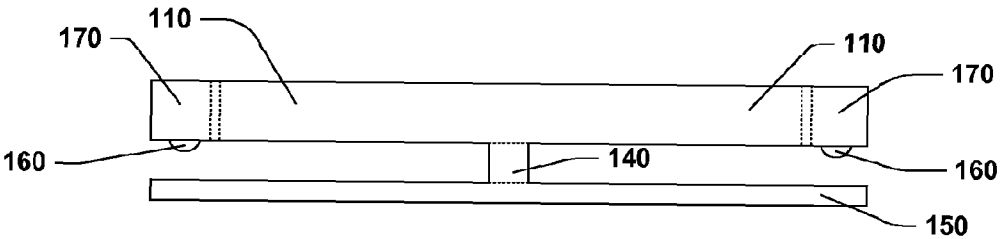
FIG. 1*d* is a diagram illustrating a side view of a back-plate diaphragm assembly with anti-stiction features in accordance with an aspect of the present invention.
Figure 1E:
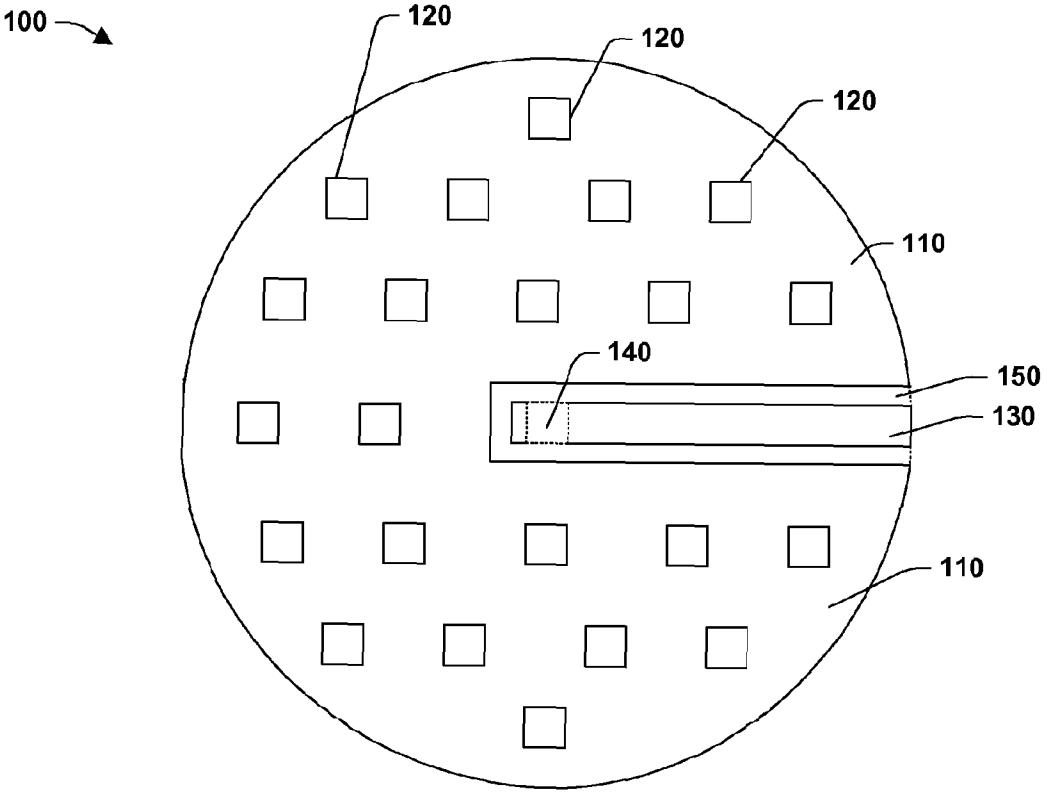
FIG. 1*e* is a diagram illustrating a top view of a back-plate diaphragm assembly with a supporting beam clamped on one end in accordance with an aspect of the present invention.
Figure 1F:
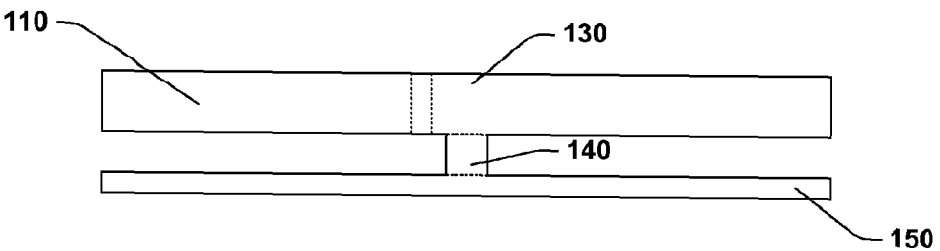
FIG. 1*f* is a diagram illustrating a side view of a back-plate diaphragm assembly with a supporting beam clamped on one end in accordance with an aspect of the present invention.

Next, referring to FIGS. 1*e* and 1*f*, a top and side view of the back-plate diaphragm assembly with a supporting beam clamped on one end is illustrated according to one aspect of the present invention. The supporting beam 130 can be a cantilever clamped on one end. The attachment/anchor 140 can be couple to the other end of the supporting beam 130. The supporting beam 130 can be mechanically and electrically separated from the back-plate electrode 110.

Figure 1G:
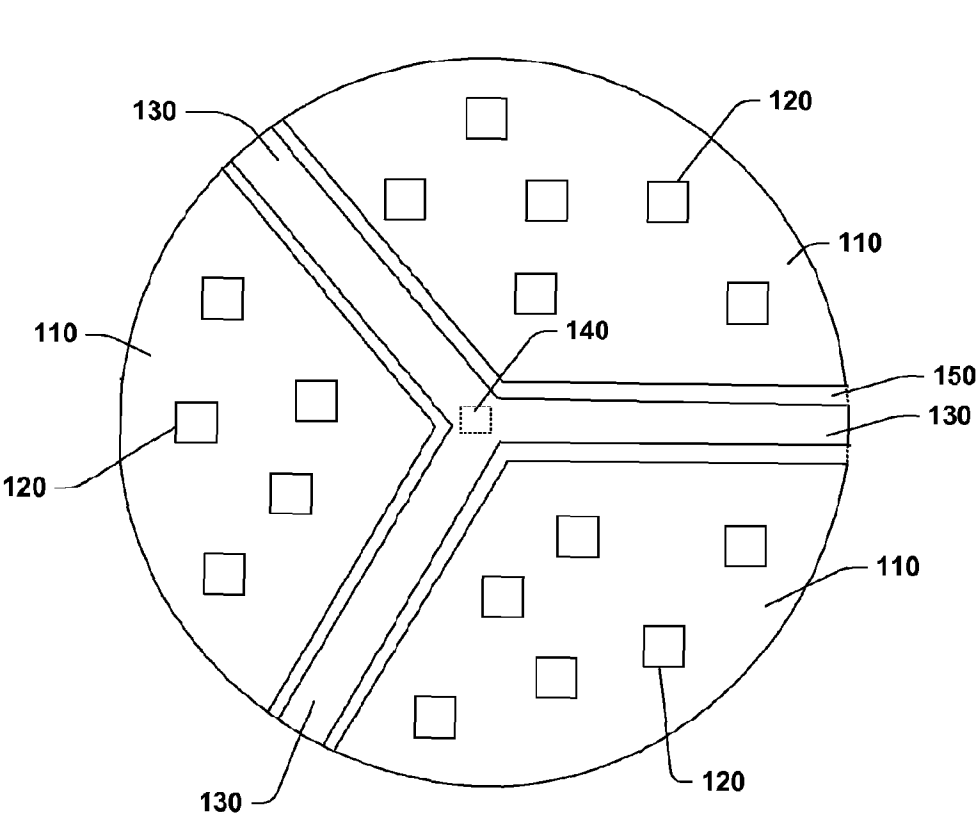
FIG. 1*g* is a diagram illustrating a top view of a back-plate diaphragm assembly with a supporting beam clamped on three ends in accordance with an aspect of the present invention.
Figure 1H:
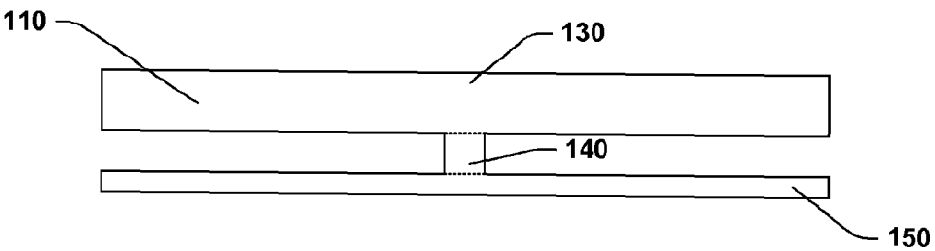
FIG. 1*h* is a diagram illustrating a side view of a back-plate diaphragm assembly with a supporting beam clamped on three ends in accordance with an aspect of the present invention.

FIG. 1*g* and 1*h* illustrate top and side views of the back-plate/diaphragm assembly with a supporting beam clamped on three ends according to another aspect of the present invention. The supporting beam 130 can consist of three segments where each segment can be clamped at one end at the perimeter of the back-plate diaphragm assembly. The three segments of the supporting beam 130 can join at the center to provide support for the attachment/anchor 140 and the diaphragm disk 150. The back-plate electrode 110 can be divided into three sections where the supporting beam 130 can be situated in between the three sections of the back-plate electrode 110. Each segments of the supporting beam 130 can be mechanically and electrically separated from the three sections of the back-plate electrode 110.

Figure 1I:
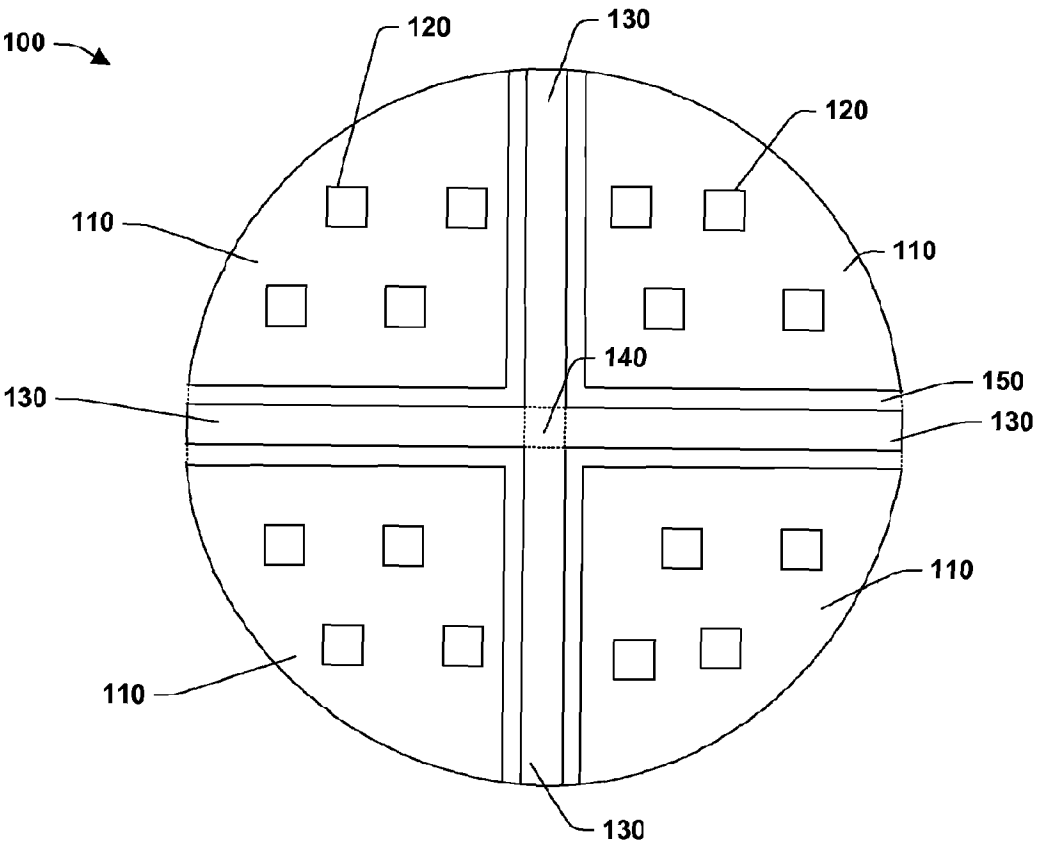
FIG. 1*i* is a diagram illustrating a top view of a back-plate diaphragm assembly with a supporting beam clamped on four ends in accordance with an aspect of the present invention.
Figure 1J:
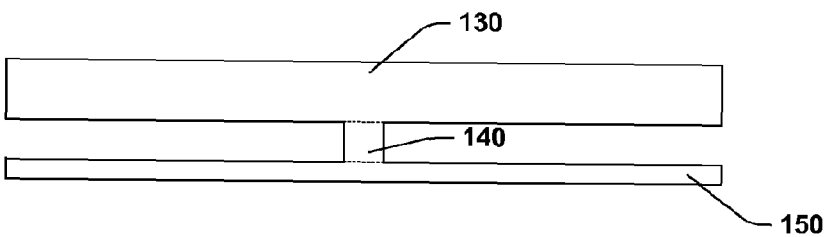
FIG. 1*j* is a diagram illustrating a side view of a back-plate diaphragm assembly with a supporting beam clamped on four ends in accordance with an aspect of the present invention.

Next, referring to FIGS. 1*i* and 1*j*, a top and side view of the back-plate diaphragm assembly with a supporting beam clamped on four ends is illustrated according to yet another aspect of the present invention. The supporting beam 130 can consist of four segments where each segment can be clamped at one end at the perimeter of the back-plate diaphragm assembly. The four segments of the supporting beam 130 can join at the center to provide support for the attachment/anchor 140. The back-plate electrode 110 can be divided into four sections. The four segments of the supporting beam 130 can be situated in between the four sections of the back-plate electrode 110. It is to be appreciated that various configurations and modifications of supporting beam 130 can also be implemented to facilitate supporting a diaphragm disk 150 at the center.

Generally, the operation of a microfabricated microphone is similar to the operation of a traditional condenser/capacitor microphone. The diaphragm disk 150 and the back-plate electrodes 110 form the plates of a parallel-plate capacitor. Fluctuating impinging sound pressure entering a mechanical acoustic port can dynamically deform the diaphragm disk 150, which dynamically alters the distance between the diaphragm disk 150 and the back-plate electrodes 110. This deformation causes the capacitance between the diaphragm disk 150 and the back-plate electrodes 110 to vary. These changes in capacitance are typically amplified to convert the acoustical energy into a measurable electrical signal.

The design of the back-plate electrodes 110 enables a simple fabrication process. A plurality of perforations 120 in the back-plate electrodes 110 can serve as air holes allowing air to freely enter and exit the diaphragm-back-plate gap. Additionally, the perforations 120 allow for sufficient porosity for air flow in the back-plate electrodes 110 which further improves squeeze film damping.

Since the diaphragm disk 150 is anchored at its center and not at its peripheral diameter, the diaphragm disk 150 can relax residual stress by allowing the diaphragm disk 150 to relax through radial contraction or expansion. Further, the center-supported diaphragm 150 can simulate a center-clamped disk to cover the acoustic port of a microfabricated microphone. In addition, the center-supported diaphragm 140 is more compliant than a conventional clamped or simply-supported diaphragm (e.g., the 'freeplate scheme' as mentioned supra is generally an example of the latter), thus improving sensitivity. Since the center-supported diaphragm 150 is not fixed around its peripheral, there is a peripheral gap between the center-supported diaphragm 150 and the acoustic port. The peripheral gap can provide for pressure equilibration.

The sense capacitance of the microfabricated microphone can be changed through a variety of enhancements. The gap between the diaphragm 150 and the back-plate electrodes 110 can be varied according to desired applications (e.g., from 2 to 1 μm). The radius of the poly-silicon diaphragm 150 and/or the back-plate electrodes 110 can also be modified to accommodate different performance needs (e.g., from 175 to 275 μm). Further, the thickness of the poly-silicon diaphragm disk 150 can be adjusted to achieve optimal performance according to different applications (e.g., from 1 to 0.5 μm).

It may be further desirable to use multiple smaller elements in order to accommodate fabrication constrains (e.g., a 2×2 or 3×3 array). Additionally, multiple smaller elements can be tuned to maximize performance in certain frequency or amplitude ranges. Furthermore, the use of multiple smaller elements may not result in significant surface area and/or volume losses compared to the use of one large element.

Interplay of the stiffness of the supporting beam 130 and diaphragm disk 150 can also be used to modify the characteristics of a microfabricated microphone. Typically, the stiffness of the supporting beam 130 can be many times that of the diaphragm disk 150. As a result, the capacitance change comes primarily from the deformation of the diaphragm disk 150 rather than from the translation of the diaphragm disk 150 due to the center deflection of the supporting beam 130. This mechanical characteristic substantially eliminates acceleration sensitivity and is consistent with the desirability of a thick back-plate layer. On the other hand, various design optimizations for different applications can be accomplished by adjusting the relative stiffness of the diaphragm disk 150 and the supporting beam 130.

In addition to the various design parameters discussed above, another way to optimize the disk compliance without affecting the dimension of the mechanical structure is to create cuts in the diaphragm disk 150. For example, different amounts and shapes of cuts can be created in the diaphragm disk 150. The shapes or amounts of cuts can be varied to also alter the sensing capacitance of a microfabricated microphone, and affect release time during the fabrication process.

Referring now to FIG. 1*c* and FIG. 1*d*, a top and side view of the back-plate diaphragm assembly with anti-stiction dimples 160 is illustrated according to one aspect of the present invention. Because the diaphragm disk 150 is thin and has relatively lower rigidity and very smooth surfaces, during the release step of the fabrication process or field operation, the diaphragm disk 150 may bend and touch the features (e.g., back-plate electrode 110, supporting beam 130, etc.) made from the back-plate layer. Upon touching the back-plate layer features, the diaphragm disk 150 might become adhered to these features due to stiction forces. The diaphragm disk 150 might not be able to free from the adhesion during the fabrication process or field operation, disrupting the device function. Alternatively or contemporaneously, undesirable electrical shorting of the sense capacitance may take place. To prevent these problems, anti-stiction dimples/limit stops 160 can be implemented from the back-plate layer, around the periphery of the diaphragm, from mechanically and electrically isolated features 170 that are etched from the back-plate layer and distributed strategically along the circumference. Such anti-stiction dimples/limit stops 160 can also be incorporated into the supporting beam 130. These mechanically and electrically isolated features 170 can be in the shape of very short (e.g., stubby) cantilevers incorporating the dimples 160, where these short cantilevers 170 are mechanically and electrically isolated from the back-plate electrode 110. The anti-stiction dimples/limit stops 160 can mitigate contacting and/or adhesion of diaphragm disk 150 to the back-plate electrode 110 and supporting beam 130. Additionally, the anti-stiction dimples/limit stops 160 provide a simply-supported boundary condition, which is more acquiescent than an otherwise clamped boundary condition and enhances sensitivity. The presence of mechanically and electrically isolated features 170 incorporating the anti-stiction dimples/limit stops 160 can negatively impact the structural stiffness of the back-plate electrode 110 since they disrupt the continuous clamping of the back-plate electrode 110 onto the substrate. However, these mechanically and electrically isolated features 170 incorporating the anti-stiction dimples/limit stops 160 can be optimized to minimally impact the stiffness of the back-plate electrode 110 due to the resulting clamped boundary discontinuities.

Figure 2:
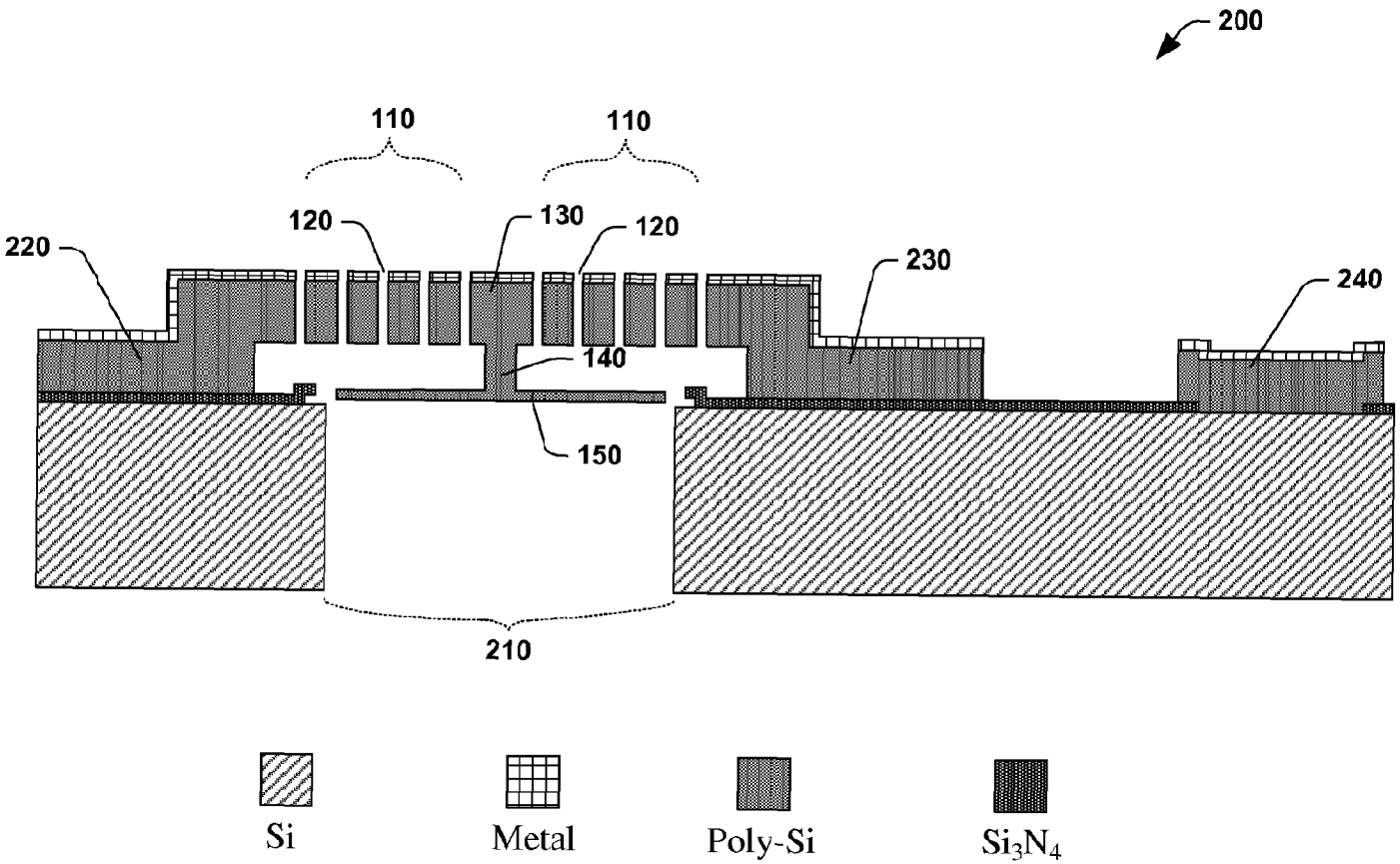
FIG. 2 is a cross sectional view of a microfabricated microphone consisting a center-supported diaphragm in accordance with an aspect of the present invention.

Referring now to FIG. 2, a cut-away view of a microfabricated microphone 200 with a center-supported diaphragm is illustrated in accordance with an aspect of the present invention. The microfabricated microphone 200 typically can include various dielectric layers. As shown in FIG. 2, a metal layer and a poly-silicon layer can make up the thick top back-plate poly-silicon layer. The thick top poly-silicon layer can form both the back-plate electrode 110 and the supporting beam 130. There can be a plurality of perforations 120 in the back-plate electrode 110. Attachment/anchor 140 can be suspended from the supporting beam 130. The diaphragm disk 150 can be supported at its center by the electrically-conductive anchor 140 formed from the same poly-silicon layer.

The diaphragm disk 150 can be a single circular plate made from a thinner, bottom-layer poly-silicon. As depicted in FIG. 2, the supporting beam 130, the attachment/anchor 140, and the diaphragm disk 150 can be mechanically and electrically connected, but they can be mechanically and electrically isolated from the back-plate electrode 110. Therefore, the diaphragm disk 150 and the back-plate electrode 110 can form a capacitor to implement microphone operations. Since the diaphragm disk 150 is not fixed at its peripheral diameter, it can allow radial expansion or contraction to release residual stress. The center-supported diaphragm disk 150 is also mechanically more compliant than a conventional clamped or a simply-supported diaphragm. Thus, the center-supported diaphragm disk 150 can enhance sensitivity.

As shown in FIG. 2, a $Si_3N_4$ layer can be provided to electrically isolate the Si substrate. The Si substrate can be patterned to form an acoustic port 210 to allow sound pressure to enter and dynamically deform the diaphragm disk 150. Disk bond pad 220 can be electrically connected to the diaphragm disk 150 through the supporting beam 130 and the electrically-conductive anchor 140. The disk bond pad 220 can serve as the electrical connection to the diaphragm disk 150 assembly. On the other hand, the back-plate bond pad 230 can be electrically connected to the back-plate electrode 110 and thus can provide electrical connection to the back-plate electrode 110. Bond pad 240 provides top-side electrical contact to the Si substrate. It is to be appreciated that the microfabricated microphone 200 as depicted in FIG. 2 is exemplary in nature and alternative structures and materials can be employed to form the microfabricated microphone 200 comprising a center-supported diaphragm.

Referring now to FIG. 3 through 10, various stages of the formation of microfabricated microphone according to one or more aspects of the present invention is illustrated.

In general, wafer processing hinges on employment of a lithographic process to create the fine featured patterns of integrated circuits. Each layer of the device is defined by a specific mask. The mask can be made by patterning a film of chromium on a pure quartz glass plate to form the reticles. The patterns are formed on the chromium plated quartz plated by removing the chromium with either laser or electron-beam driven tools. The wafer, covered with a thin photo sensitive film known as photoresist can then be exposed through the mask to pattern the photoresist. The wafer with patterned photoresist is then put into an etch process to remove the underlying film where there is no pattern. The etch may be either a classic wet chemistry or a "dry" plasma etch chemistry. The photoresist is then stripped away by employing wet and/or dry strippers.

Figure 3:
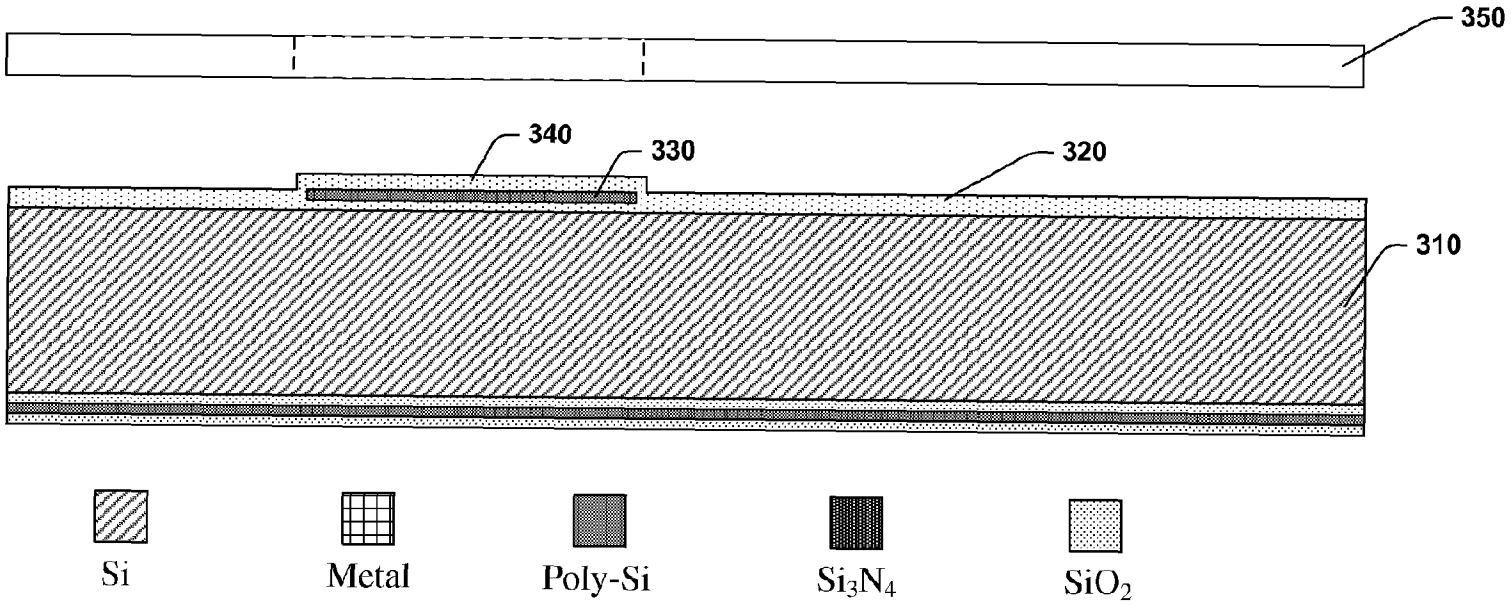
FIGS. 3 through 10 illustrate selected stages of the wafer processing to form a microfabricated microphone consisting of a center-supported diaphragm according to one aspect of the present invention.

In FIG. 3, the fabrication process can start with a low-resistivity, n-type Si wafer 310. A thin oxide 320 can be grown on the wafer. For example, the thin oxide 320 can be approximately 100 nm. Next, an n-type Low Pressure Chemical Vapor Deposition (LPCVD) mechanical poly-silicon 330 with desired diaphragm disk 150 thickness (e.g., 0.5 to 1 μm) can be deposited. Utilizing a mask 350, the poly-silicon 330 on the front side can then be patterned according to a desired design shape to form the diaphragm disk 150. A thin (e.g., 100 nm) Low Temperature Oxide (LTO) deposition 340 can then cover the patterned poly-silicon 330. The thin LTO deposition 340 can protect the patterned poly-silicon 330 during subsequent fabrication processes.

Figure 4:
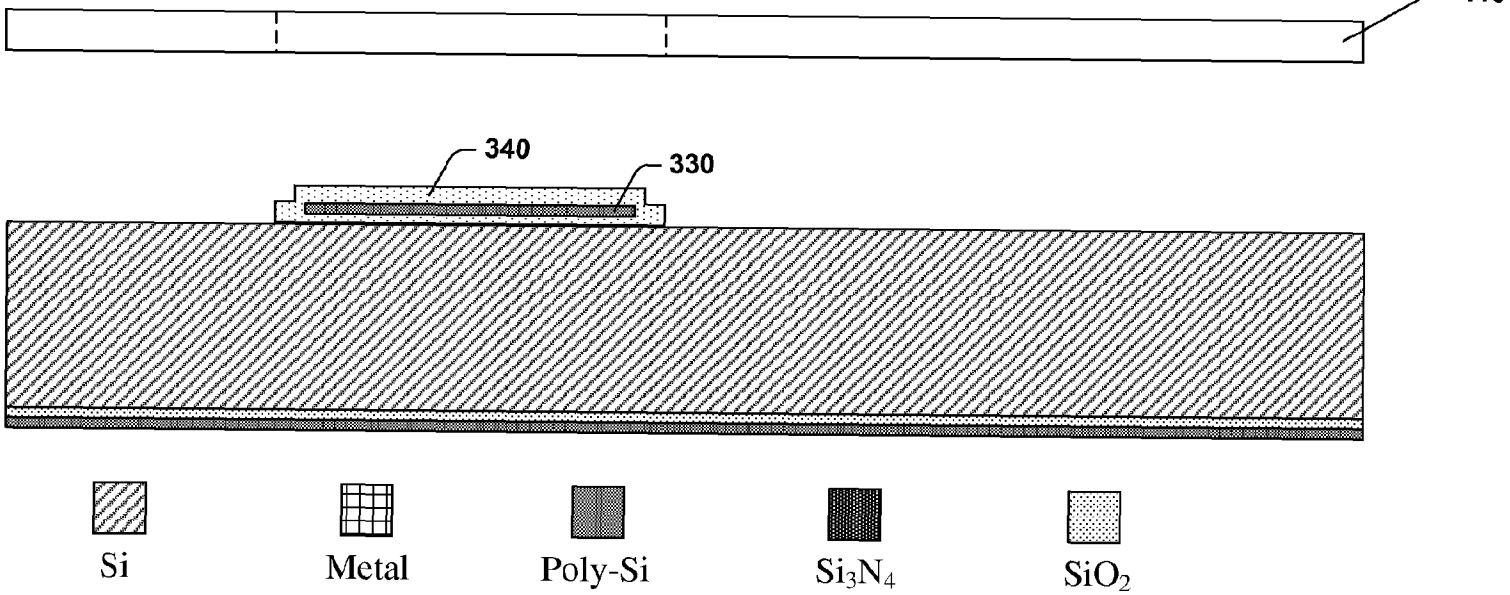
Figure 5:
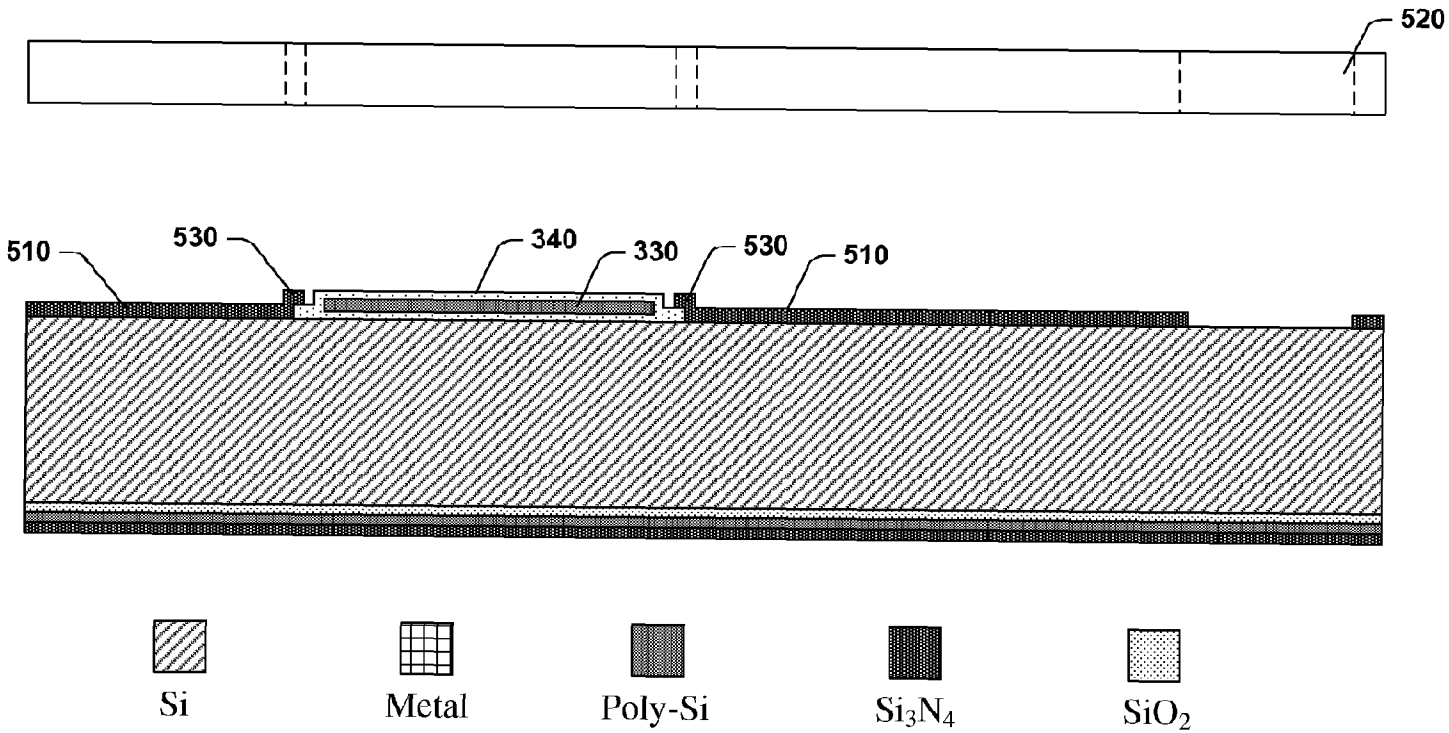
Figure 6:
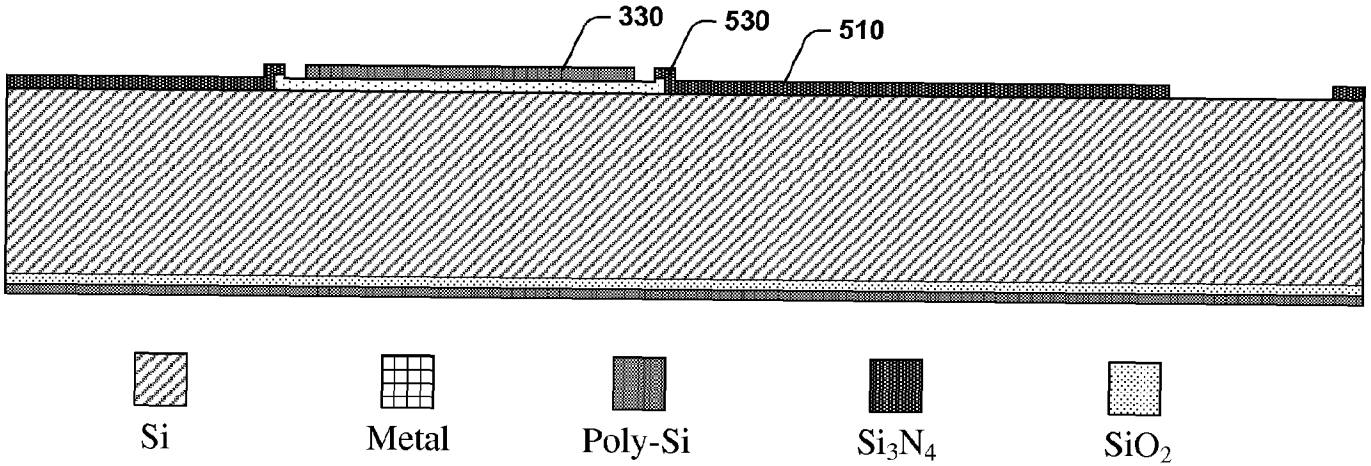

Referring now in FIG. 4, another mask 410 can be used to pattern the thin oxide 320 on the front side. Utilizing mask 410, the thin oxide 320 can be patterned to accommodate a LPCVD nitride layer in the subsequent fabrication process. A thin layer of oxide 340 can remain on top of the poly-silicon 330 as protection from later fabrication processes. Next, as depicted in FIG. 5, a LPCVD nitride 510 can be deposited. A mask 520 can be used to pattern the LPCVD nitride 510 to form etch end points 530 around the poly-silicon diaphragm disk 330, as well as to expose the Si substrate where the top side substrate contact pad will be formed. The thin LTO deposition 340 over the poly-silicon diaphragm disk 330 can provide protection to the poly-silicon diaphragm disk 330 from the LPCVD nitride etch. Subsequently, any remaining back side nitride layers can be removed. Subsequently as shown in FIG. 6, the thin LTO deposition 340 covering the poly-silicon diaphragm disk 330 can be removed in a timed Buffered Oxide Etch (BOE) process.

Figure 7:
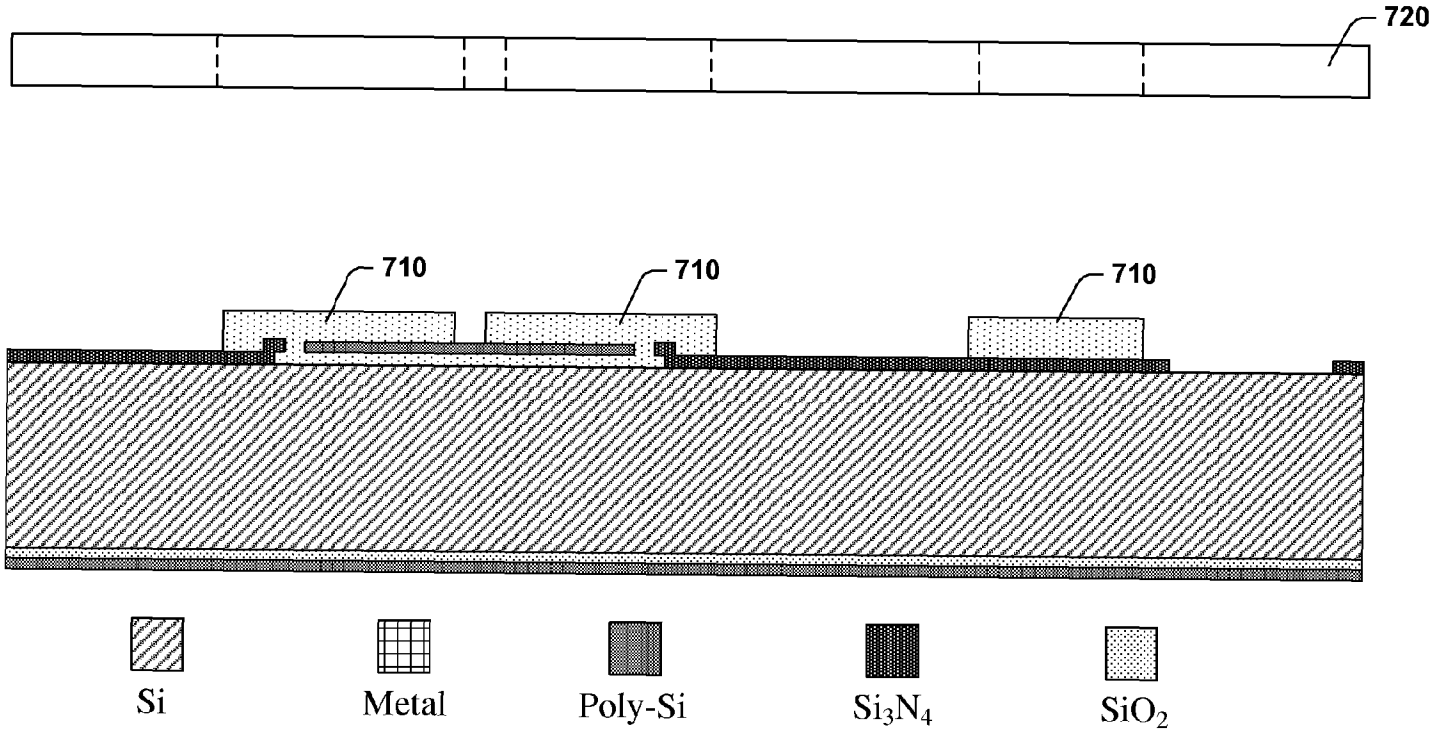

Afterward, by referring to FIG. 7, a sacrificial LTO layer 710 can be deposited. For example, this sacrificial LTO layer 710 can be approximately 2 μm. A mask 720 can be utilized to pattern the sacrificial LTO layer 710 on the front side. The sacrificial LTO layer 710 can be patterned according to desired dimensions of the sensing capacitor. Depending on the design minimum features, this can be done in BOE or a combination of dry etch followed by BOE. Next, any remaining back side LTO layers can be removed.

Figure 7A:
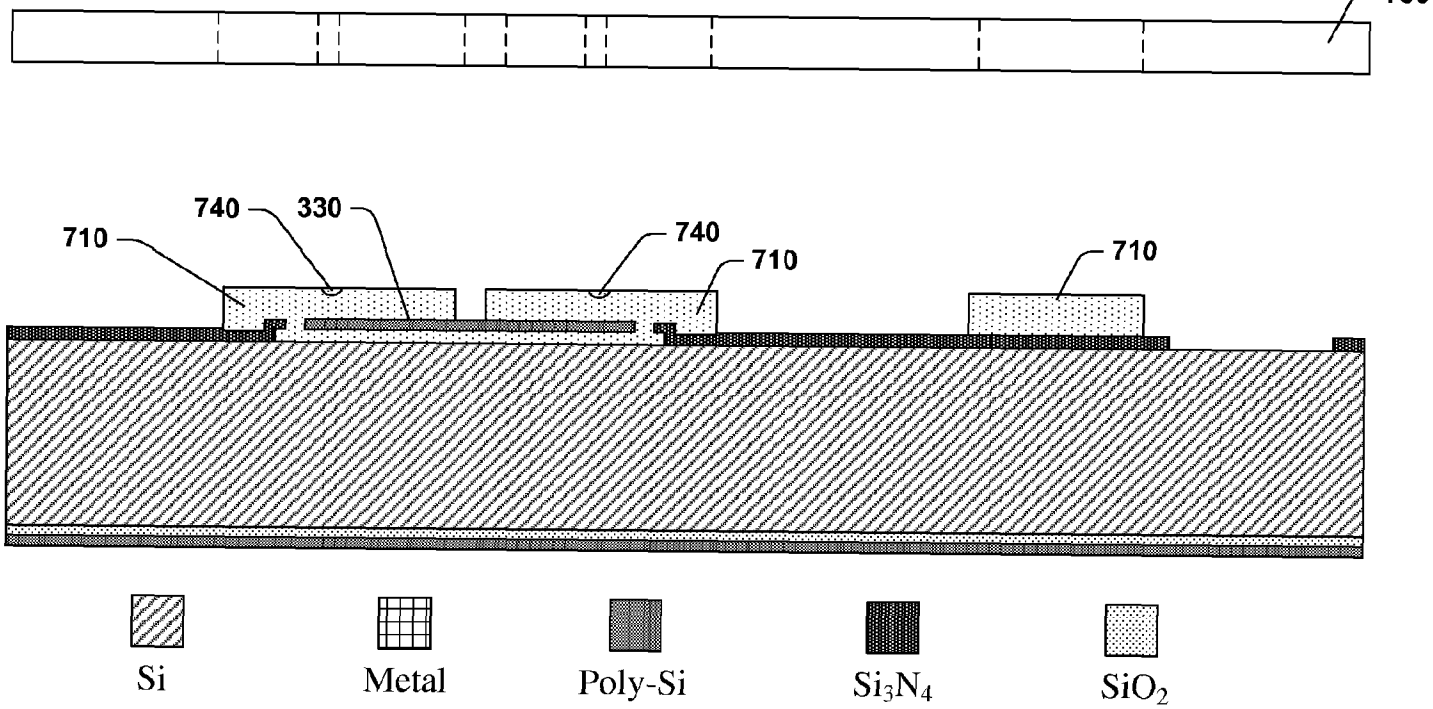

Referring now to FIG. 7*a*, an optional mask 730 can be used before mask 720 to define stiction-prevention dimple/limit stop molds 740 in the sacrificial LTO layer 710 if any stiction-prevention dimples/limit stops are desired. As discussed above, these anti-stiction dimples/limit stops can mitigate adhesion of diaphragm disk 330 to the back-plate features. Depending on the desired physical dimensions of the back-plate and diaphragm disk assembly 100, these anti-stiction dimples/limit stops can be strategically distributed to prevent adhesion of the diaphragm disk 330 to the back-plate features due to stiction forces.

Figure 8:
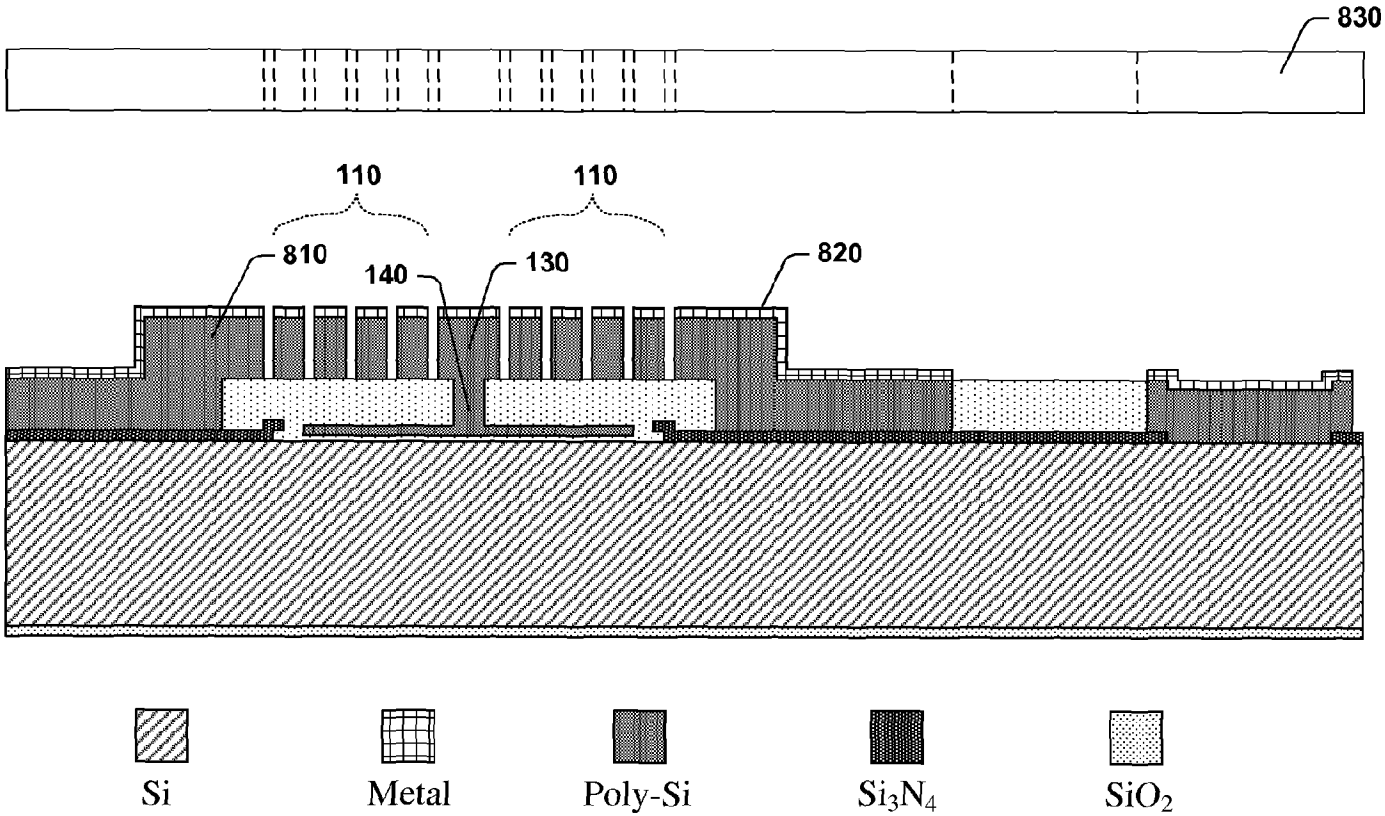

Referring now to FIG. 8, an n-type LPCVD mechanical poly-silicon layer 810 can be deposited to form the back-plate of the microfabricated microphone. The thickness of the poly-silicon layer 810 can be chosen according to the desired thickness of back-plate electrode 110 and supporting beam 130. A metal layer 820 can then be deposited on top of the poly-silicon layer 810. The composition of the metal layer 820 can be based on its compatibility with the oxide release step later in the fabrication process. Both the poly-silicon layer 810 and the metal layer 820 can then be patterned by a mask 830 to form the back-plate electrode 110, anchor 140, supporting beam 130, and anti-stiction features 170. Any back side poly-silicon can then be removed.

Figure 9:
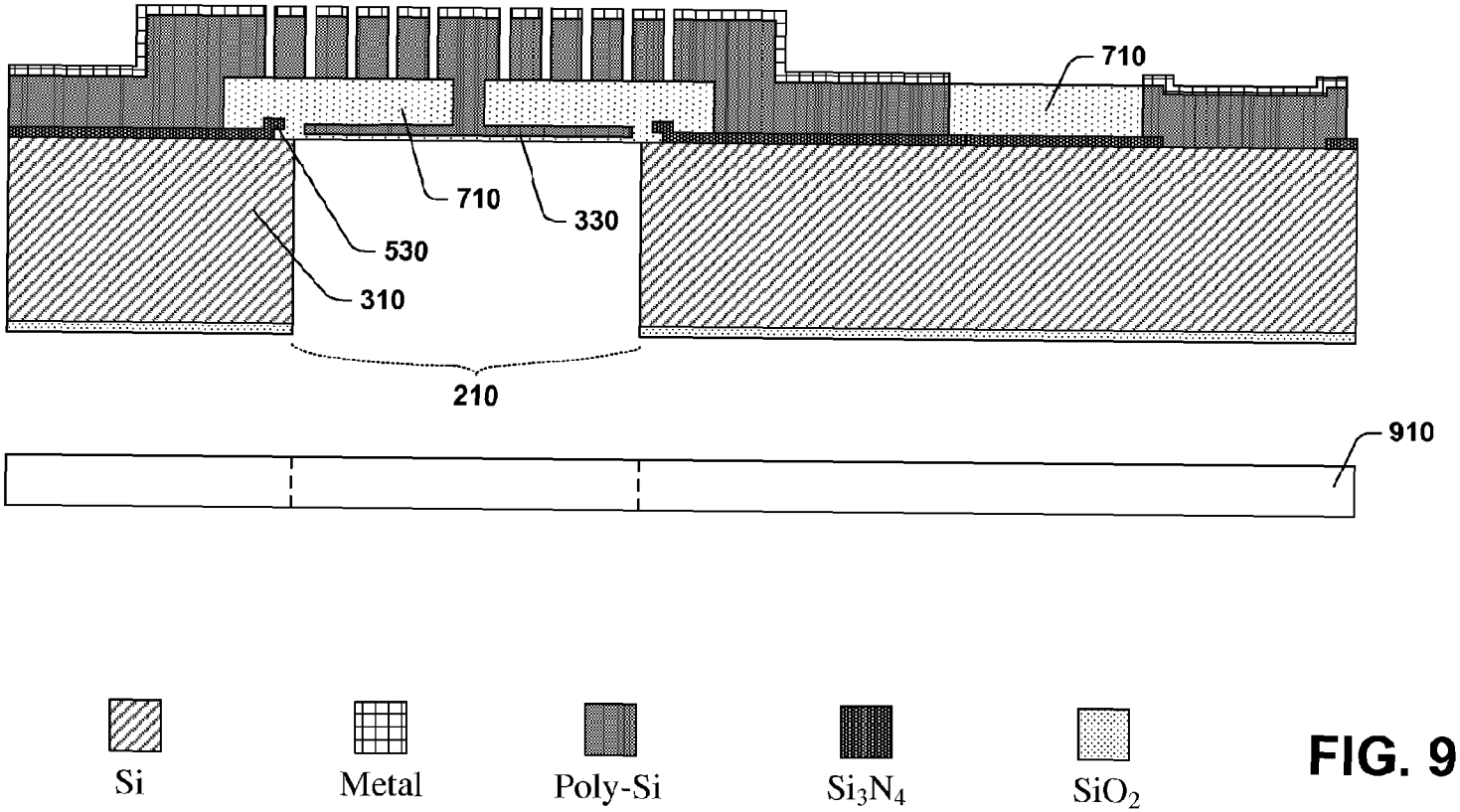
Figure 10:
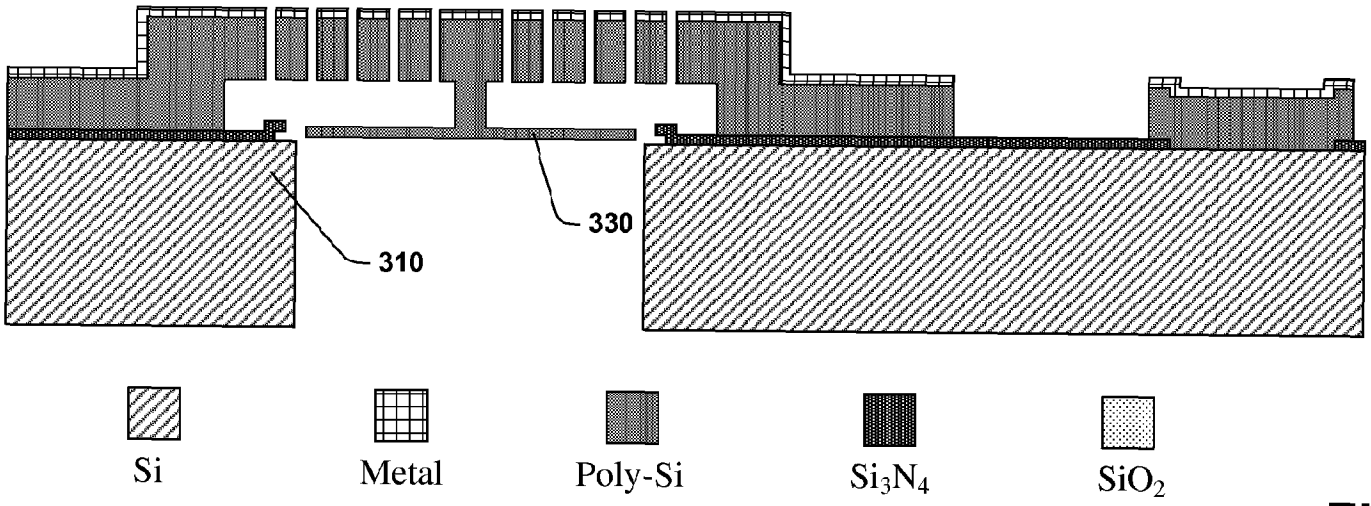

Next, depicted in FIG. 9, an acoustic port 210 can be created by etching from the back side with Deep Reactive Ion Etching (DRIE) by utilizing mask 910. The size of the acoustic port 210 can be slightly larger than the disk 330 to avoid stiction of the diaphragm disk 330 at its periphery to the Si substrate 310. The gap between the diaphragm disk 330 and the Si substrate 310 can be kept as small as possible to minimize acoustic air flow around the diaphragm disk 330. This gap can be kept within an alignment tolerance. Alternatively, it can be set by the gap between the periphery of the diaphragm disk 330 and nitride end points 530, relaxing the backside alignment requirement. Next in FIG. 10, the fabrication process can be finished by dissolving the sacrificial oxide 710.

Figure 11:
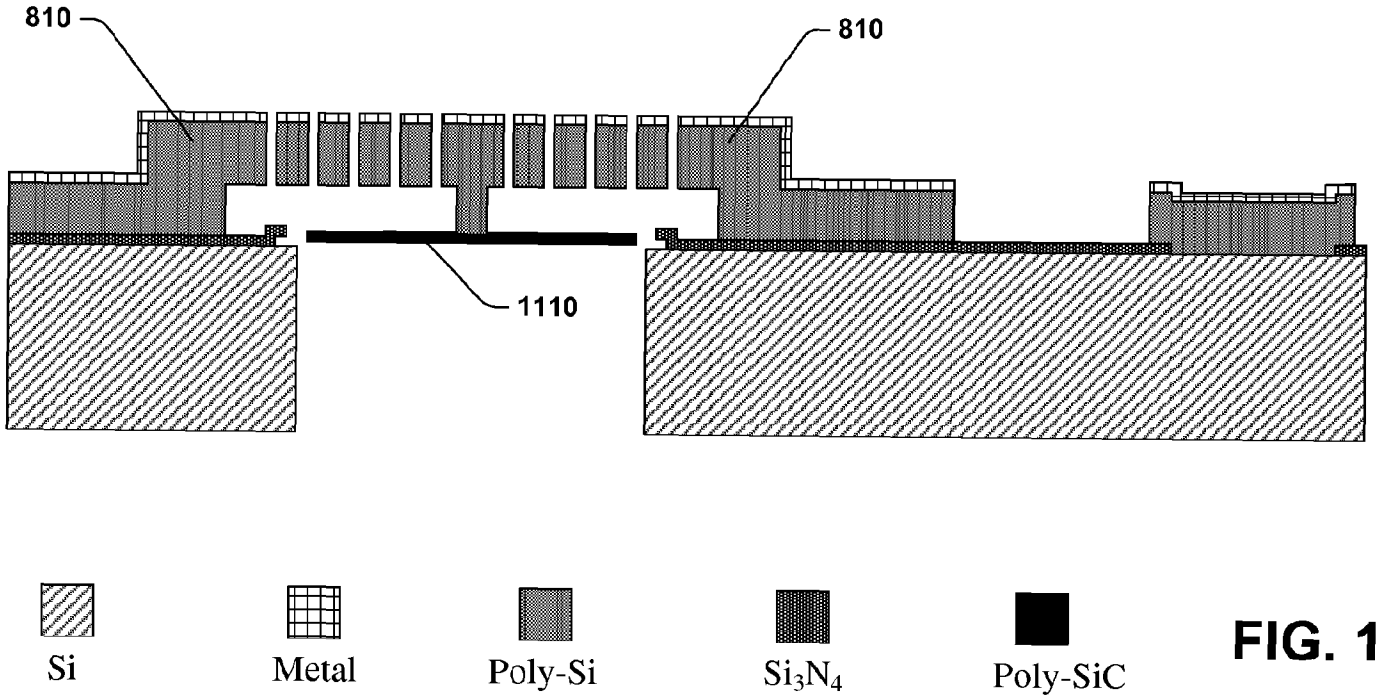
FIG. 11 illustrates a cross sectional view of a microfabricated microphone with an alternative center-supported diaphragm in accordance with an aspect of the present invention.

FIG. 11 illustrates an alternative microfabricated microphone 1100 in accordance with an aspect of the present invention. A polycrystalline silicon carbide (poly-SiC) diaphragm disk 1110 can be used in place of a poly-silicon diaphragm disk 330. This can be accomplished by replacing the first poly-silicon layer 330 in the above described fabrication process with n-type LPCVD poly-SiC. It can also be appreciated that other suitable materials can also be used for the diaphragm disk 330 to accommodate various design requirements and achieve optimal performance of a microfabricated microphone. The same material considerations can apply to the back-plate layer 810, e.g., replacing the thick back-plate poly-silicon layer 810 with poly-SiC.

What have been described above are one or more aspects of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims. In addition, while a particular feature of the invention may have been disclosed with respect to only one of several implementations, such feature may be combined with one or more other features of the other implementations as may be desired and advantageous for any given or particular application. Furthermore, to the extent that the term "includes" is used in either the detailed description and the claims, such term is intended to be inclusive in a manner similar to the term "comprising."

What is claimed is:

1. A microfabricated microphone comprising:

a back-plate electrode comprising an electrically conductive material disposed on a back-plate layer of dielectric material;

a substrate of an insulating material, an aperture formed in the substrate to provide an acoustic port, the acoustic port having a sidewall extending from an open distal end to a proximal end where the back-plate electrode resides covering and spaced apart from the acoustic port; and a center-supported diaphragm supported relative to the back-plate electrode by a center support extending from the back-plate electrode in a direction toward the acoustic port, the center-support configured to support the diaphragm located near the proximal end of the acoustic port with a gap between a perimeter of the diaphragm and the acoustic port, thereby allowing residual stress to relax through radial expansion or contraction of the diaphragm while maintaining radial and angular symmetry of the diaphragm.

2. The microfabricated microphone of claim 1, further comprising:

at least one anchor supporting the diaphragm at the diaphragm's center; and at least one supporting beam coupled to the anchor.

3. The microfabricated microphone of claim 1, wherein the center-supported diaphragm is made of a thin, bottom layer poly-silicon.

4. The microfabricated microphone of claim 2, wherein the back-plate electrode and the supporting beam are made of a thick, top layer poly-silicon.

5. The microfabricated microphone of claim 2, wherein the supporting beam is situated in between opposing portions of a plurality of electrode sections of the back-plate electrode.

6. The microfabricated microphone of claim 2, wherein the supporting beam is mechanically and electrically separated from the back-plate electrode.

7. The microfabricated microphone of claim 5, wherein the plurality of electrode sections of the back-plate electrode are electrically connected and form a capacitor with the diaphragm disk.

8. The microfabricated microphone of claim 2, wherein the anchor, the diaphragm and the supporting beam are mechanically and electrically connected.

9. The microfabricated microphone of claim 2, further comprising at least one perforation in the back-plate electrode.

10. The microfabricated microphone of claim 1, wherein the diaphragm comprises a circular plate that simulates a center-clamped disk to cover the acoustic port.

11. The microfabricated microphone of claim 10, wherein a peripheral gap between the diaphragm and the acoustic port provides for pressure equilibration.

12. The microfabricated microphone of claim 2, wherein sense capacitance is controlled by adjusting at least one of: a gap between the diaphragm and the back-plate electrode, a radius of the diaphragm, or a radius of the back-plate electrode.

13. The microfabricated microphone of claim 2, wherein acceleration sensitivity is militated against by at least one of: interplay of the supporting beam's stiffness and the diaphragm's stiffness, or interplay in the context of the physical dimensions of the diaphragm disk and the back-plate electrode.

14. The microfabricated microphone of claim 1, further comprising one or more cuts in the diaphragm.

15. The microfabricated microphone of claim 4, further comprising at least one anti-stiction dimple or limit stop incorporated in electrically and mechanically isolated features and located on the back-plate electrode.

16. A method of fabricating a microfabricated microphone comprising:

forming, in a substrate, an aperture to provide an acoustic port, the acoustic port having a sidewall extending from an open distal end to a proximal end where the back-plate electrode resides covering and spaced apart from the acoustic port;

microfabricating a back-plate electrode to include at least one electrode section; and microfabricating a diaphragm with a center support extending from the back-plate electrode in the direction of the acoustic port, the center-support configured to support the diaphragm located near the proximal end of the acoustic port with a gap between a perimeter of the diaphragm and the acoustic port, thereby allowing residual stress to relax through radial expansion or contraction of the diaphragm while maintaining radial and angular symmetry of the diaphragm.

17. The method of claim 16, further comprising:

microfabricating the back-plate electrode comprising at least one section from a thick, top poly-silicon layer;

microfabricating a supporting beam from the thick, top poly-silicon layer, where the supporting beam is situated between the sections of the back-plate electrode, and microfabricating an anchor attached to the supporting beam.

18. The method of claim 16, further comprising microfabricating at least one anti-stiction dimple or limit stop incorporated in electrically and mechanically isolated features on the back-plate electrode.

19. A microfabricated microphone comprising:

a diaphragm;

a back-plate electrode comprising plural electrode sections, wherein the electrode sections form a capacitor with the diaphragm; and a center support extending between the back-plate electrode and the diaphragm in a direction toward an acoustic port, the center support configured to support the diaphragm in a superimposed relationship relative to the electrode sections of the back-plate electrode at an axial location near the acoustic port, the diaphragm located at a proximal end of the acoustic port, the center-support allowing residual stress to relax through radial expansion or contraction of the diaphragm while maintaining radial and angular symmetry of the diaphragm.

20. The microfabricated microphone of claim 1, wherein the diaphragm is supported by the center support in a superimposed relationship to the back-plate electrode.

21. The microfabricated microphone of claim 2 wherein the anchor is formed with the back-plate electrode.

22. The method of claim 16, wherein the anchor is patterned in the same fabrication step as the back-plate electrode.

* * * * *